US007918263B2

(12) United States Patent
Kraeutler

(10) Patent No.: US 7,918,263 B2
(45) Date of Patent: Apr. 5, 2011

(54) HIGH-SPEED DOOR WITH A FLEXIBLE CURTAIN

(75) Inventor: Bernard Kraeutler, La Villette (FR)

(73) Assignee: Nergeco (FR)

( * ) Notice: Subject to any disclaimer, the term of this patent is extended or adjusted under 35 U.S.C. 154(b) by 0 days.

(21) Appl. No.: 12/091,788

(22) PCT Filed: Oct. 30, 2006

(86) PCT No.: PCT/IB2006/003050

§ 371 (c)(1),
(2), (4) Date: Apr. 28, 2008

(87) PCT Pub. No.: WO2007/057735

PCT Pub. Date: May 24, 2007

(65) Prior Publication Data

US 2008/0257503 A1 Oct. 23, 2008

(30) Foreign Application Priority Data

Oct. 28, 2005 (FR) ..... 05 11077

(51) Int. Cl.
*E04F 10/06* (2006.01)
*E06B 9/08* (2006.01)

(52) U.S. Cl. ..... 160/23.1

(58) Field of Classification Search ..... 160/264, 160/38, 39, 19, 23.1, 25
See application file for complete search history.

(56) References Cited

U.S. PATENT DOCUMENTS

| | | | | | |
|---|---|---|---|---|---|
| 660,473 | A | * | 10/1900 | Vandenhoff | 160/23.1 |
| 1,773,590 | A | * | 8/1930 | Mathias | 160/19 |
| 2,205,003 | A | * | 6/1940 | Walters | 156/101 |
| 2,681,697 | A | * | 6/1954 | Mandella | 160/19 |
| 2,823,743 | A | * | 2/1958 | Isaac | 160/39 |
| 5,183,093 | A | | 2/1993 | Kraeutler | |
| 5,365,990 | A | * | 11/1994 | Ueda | 160/23.1 |
| 5,544,690 | A | * | 8/1996 | Magro et al. | 160/133 |
| 6,152,208 | A | * | 11/2000 | Kalempa et al. | 160/273.1 |

(Continued)

FOREIGN PATENT DOCUMENTS

DE 3041347 6/1982

(Continued)

*Primary Examiner* — Katherine Mitchell
*Assistant Examiner* — Jaime F Cardenas-Garcia
(74) *Attorney, Agent, or Firm* — Cantor Colburn LLP

(57) ABSTRACT

This high-speed door is provided for closing a bay made in a wall (4) delimited by a lintel and by two vertical sides. The door comprises: two lateral parts placed in an essentially vertical manner against each of the vertical sides of the bay; a shaft (12) positioned at the level of the lintel of the bay and rotationally driven by electromechanical means, and; a curtain (7) made of a flexible material having a first side (7*a*) and a second side (7*b*), joined to the shaft (12), the rotation of the shaft (12) being able to move the curtain (7) between a closed position in which the curtain (7) closes the bay and an open position in which the curtain (7) opens the bay. In addition, the door comprises flexible means for protecting the shaft (12) which extend between the two lateral parts (2) and (3) and which are capable of coming in contact with the lintel, the flexible protecting means also having first transversal sealing means that can come in transversal contact with the first side (7*a*) of the curtain (7) when it is in a closed position.

17 Claims, 3 Drawing Sheets

U.S. PATENT DOCUMENTS

| | | | | |
|---|---|---|---|---|
| 6,247,517 | B1 * | 6/2001 | Drifka et al. | 160/23.1 |
| 6,390,171 | B2 * | 5/2002 | Drifka et al. | 160/23.1 |
| 6,481,487 | B2 * | 11/2002 | Simon | 160/84.06 |
| 6,873,461 | B1 * | 3/2005 | McPherson, Jr. | 359/461 |
| 7,231,953 | B2 * | 6/2007 | Varley et al. | 160/273.1 |
| 2001/0015265 | A1 * | 8/2001 | Drifka et al. | 160/23.1 |

FOREIGN PATENT DOCUMENTS

| | | |
|---|---|---|
| DE | 4002399 | 8/1991 |
| DE | 19615884 | 10/1996 |
| FR | 2842243 | 1/2004 |

* cited by examiner

HIGH-SPEED DOOR WITH A FLEXIBLE CURTAIN

The present invention relates to a door of the high-speed door type comprising a curtain that can be moved by electromechanical drive means between an open position and a closed position.

The invention relates more specifically to a door with a flexible curtain that folds or rolls and is intended quickly to close off or uncover access to an opening formed in a wall separating two areas.

In numerous fields of application it is important to obtain a good seal between the two areas that the door separates.

Conventionally, a high-speed door has two substantially vertical lateral parts which are positioned one on each side of the opening; these two lateral parts support a transverse shaft together with, possibly, electromechanical means of driving this shaft.

This general layout is found irrespective of the type of door; specifically, a high-speed door may be either of the roller type, that is to say may have a shaft on to which a flexible curtain is rolled up, or of the folding type, that is to say have a flexible curtain that is raised by straps connected on the one hand to the shaft and on the other hand to the bottom part of the curtain.

Sealing between the lateral edges of the curtain and each of the lateral parts is achieved relatively satisfactorily because the lateral parts of the door are generally provided with slideways in which each of the lateral edges of the curtain engage.

By contrast, at the transverse top of the door, it is found that sealing is not entirely satisfactory.

Specifically, in a conventional manner, a transverse cap is generally provided which connects the top ends of the lateral parts that form the door.

FIG. 1 schematically illustrates a door of this type. This figure shows that exchanges of air represented schematically using arrows may occur between the two areas separated by the door.

At the same time as exchanges of air, there can therefore also be movement of dust and exchanges of noise between the two areas.

Furthermore, the transverse cap which covers and protects the door shaft is a component that may be very long and which may therefore be very expensive.

It is an object of the present invention to remedy these disadvantages and a more particular object of the invention is to propose a door with effective sealing at the top.

Another object of the invention is to propose a door in which the upper part can be protected at modest cost.

The subject of the invention is a high-speed door intended to close off an opening made in a wall, delimited by a lintel and by two vertical edges, the door comprising:

- two substantially vertical lateral parts that can be positioned against each of the vertical edges of the opening;
- a shaft positioned at the lintel of the opening and rotationally driven by electromechanical means;
- a curtain made of flexible material having a first face and a second face and which is connected to the shaft, rotation of the shaft being able to move the curtain between a closed position in which the curtain closes off the opening, and an open position in which the curtain uncovers the opening.

According to the invention, the door has flexible means of protecting the shaft which means extend between the two lateral parts and are capable of bearing against the lintel, the protection means also possessing first transverse sealing means capable of bearing transversely against the first face of the curtain when this curtain is in the closed position.

The invention therefore anticipates producing the means that protect the shaft that drives the curtain from a flexible material and incorporating into the shaft protection means first sealing means which will be able to press against the curtain when this curtain is in the closed position.

Provision is also made for the door also to have second sealing means which may bear against the lintel and press transversely against a second face of the curtain when this curtain is in the closed position.

The invention thus makes provision for dealing with the problem of sealing on both faces of the curtain by providing the door with second sealing means which act on the second face of the curtain.

Still concerned with the problem of controlling sealing, it is envisioned for the curtain to have, on at least one of its two faces, an additional thickness that comes into contact with the first or second sealing means when the curtain is in the closed position.

This provision proves to be entirely beneficial in providing a support against which one of the sealing means or, possibly the first and second sealing means when each of the faces of the curtain is provided with an additional thickness, can bear.

According to a particularly advantageous arrangement, provision is made for the protective means to comprise a transverse cover covering the shaft, held by transverse support means parallel to the shaft and positioned around this shaft, the transverse cover being fixed to the lintel of the opening and having transverse sealing means capable of pressing against the curtain.

This entirely advantageous provision means that the top part of the door can be protected at a lower cost and by using the technology involved in manufacturing the curtain itself. What is more, the cover can house and seal the top part of the door.

According to one option, the transverse protective cover may comprise several widths, at least two of which are connected by a sleeve into which a transverse support means can be engaged.

It may also be envisioned for the cover to consist of a rectangular piece of flexible material to which at least one strip is attached in order to form a sleeve.

In one embodiment, each lateral part of the door comprises a vertical upright surmounted by a fixture supporting one end of the shaft and in which one end of a means of supporting the cover is anchored.

To hold the cover in shape, the door has at least two transverse support bars over which the cover is stretched.

According to one option, at least one transverse bar is engaged in a sleeve belonging to the cover.

In another embodiment, it is envisioned for the protection means to consist of a rigid part and of a flexible part of cover.

In order to seal against the curtain, the first sealing means may consist of a flexible skirt which extends the means of protecting the shaft and comes into contact with the curtain when this curtain is in the closed position.

It may be envisioned for the skirt to be formed of a strip of flexible material folded over on itself.

It may also be envisioned for the first sealing means to consist of a roll which extends the protection means and comes into contact with the curtain when the curtain is in the closed position.

To enhance the sealing, the roll may be filled with a cellular foam.

In order to achieve contact between the cover and the curtain, the free transverse edge of the cover may be provided with a sleeve in which an elastic element, each end of which is connected to a lateral part, is engaged.

According to one option, the second sealing means comprise a profile strip that can be fixed to the lintel and to which a flexible skirt or a roll capable of pressing against the second face of the curtain is added.

The door may be of the roller type; in this case, the curtain is fixed to the shaft and is rolled up on and unrolled from this shaft in order to open and close the door.

The door may be of the folding door type; in this case, the door comprises at least one strap connected, on the one hand, to the shaft and, on the other hand, to the curtain so that rotation of the shaft causes the curtain to be folded up toward the door lintel.

For a good understanding thereof, the invention is described with reference to the attached drawing which, by way of nonlimiting example, represents several embodiments of doors according to the invention.

For simplicity, the elements which can be found in the various forms of embodiment, bear the same references.

Figure 2:
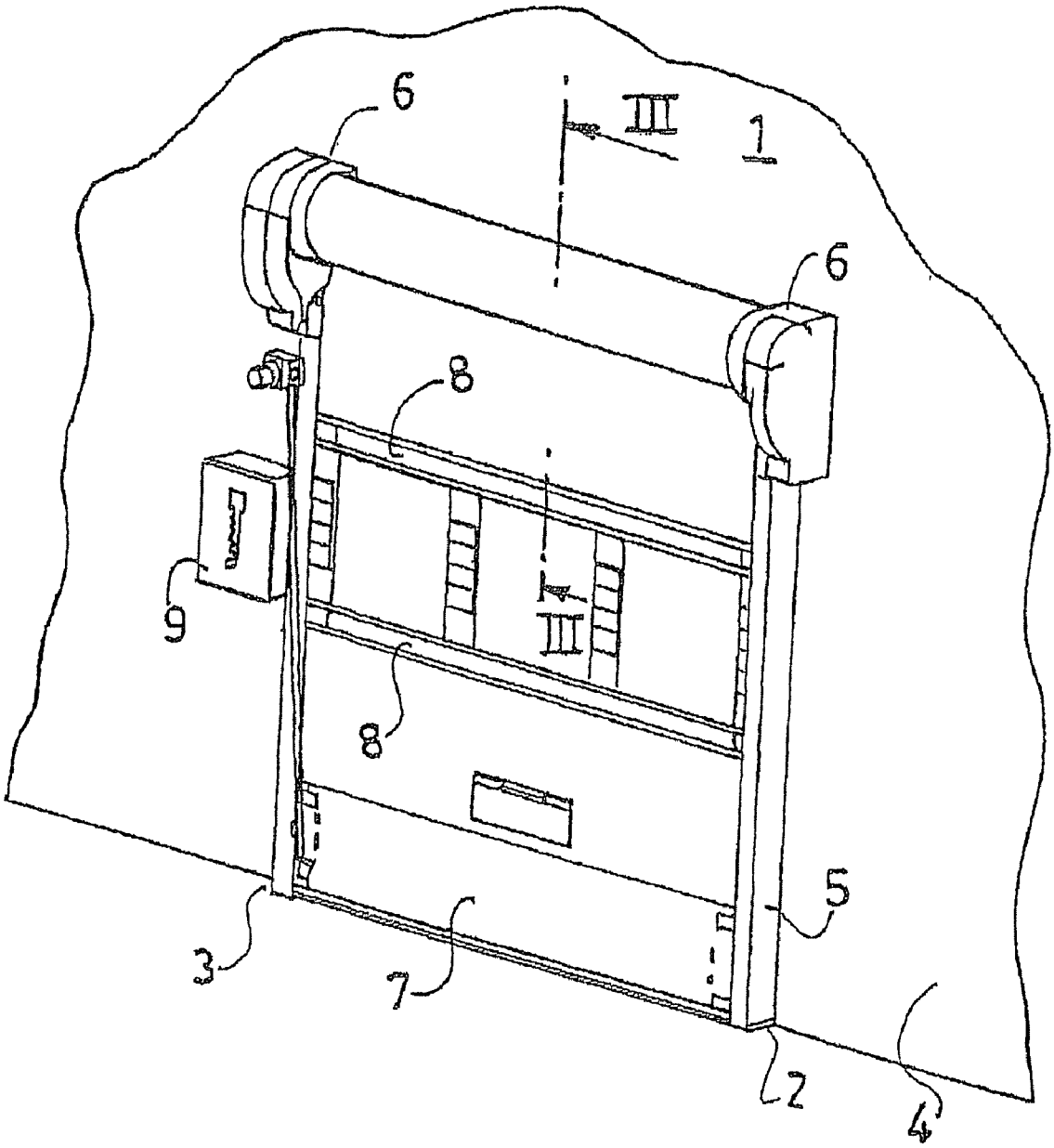
FIG. 2 shows, in perspective, a door according to the invention.

With reference first of all to FIG. 2, it can be seen that in the embodiment depicted, the door 1 comprises two lateral parts 2 and 3 which press against a wall 4 along the lateral edges of an opening made in the wall 4.

In the example depicted, each of the lateral parts 2 and 3 consists of a vertical upright 5 surmounted by a fixture 6. Between these two lateral parts 2, 3 there is a curtain 7 made of flexible material; this flexible material may, for example, be PVC. The curtain 7 has a first face 7*a* and a second face 7*b*.

It will be noted that, in the embodiment depicted, the curtain 7 is provided with several transverse stiffening bars 8 which may be made of a material that has overall flexibility.

As can be seen in FIG. 2, the vertical edges of the curtain 7, when the door is in the closed position, are engaged in slideways made in the uprights 5.

It can also be seen that the transverse bottom edge of the curtain 7 comes into contact with the ground so that vertical lateral sealing and transverse sealing at the bottom are achieved relatively satisfactorily.

In practice, leaks between the two areas that the door is supposed to separate may occur at the transverse top part of the door.

Figure 1:
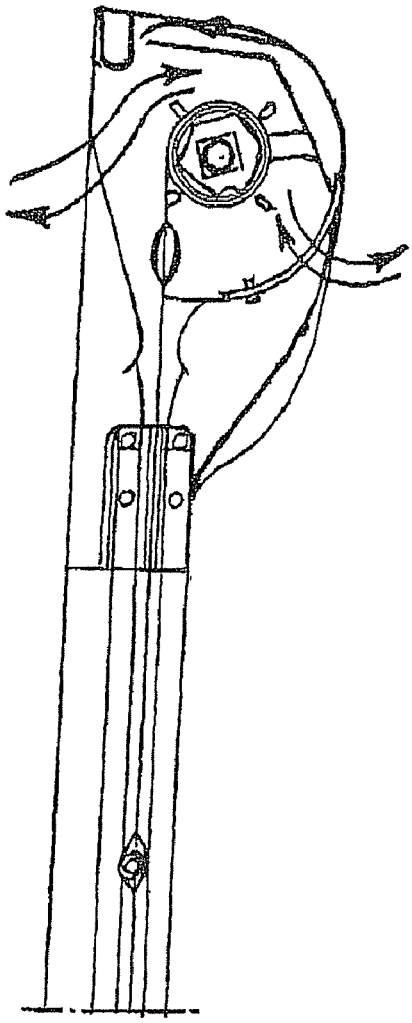
Prior Art FIG. 1
FIG. 1 shows, in cross section, a transverse cap according to the prior art.

Movement between the two areas or between the external surroundings and an internal area is illustrated in FIG. 1 which shows a door according to the prior art.

In the example illustrated in FIG. 2, the door is a door of the roller type, that is to say that a winding shaft 12 extends between each of the fixtures 6. The winding shaft 12 may be driven by an electric motor possibly with reduction gearing inserted between the electric motor and the shaft 12.

As can be seen in FIG. 2, a control cabinet 9 can be used to control the action of the electromechanical means.

Figure 3:
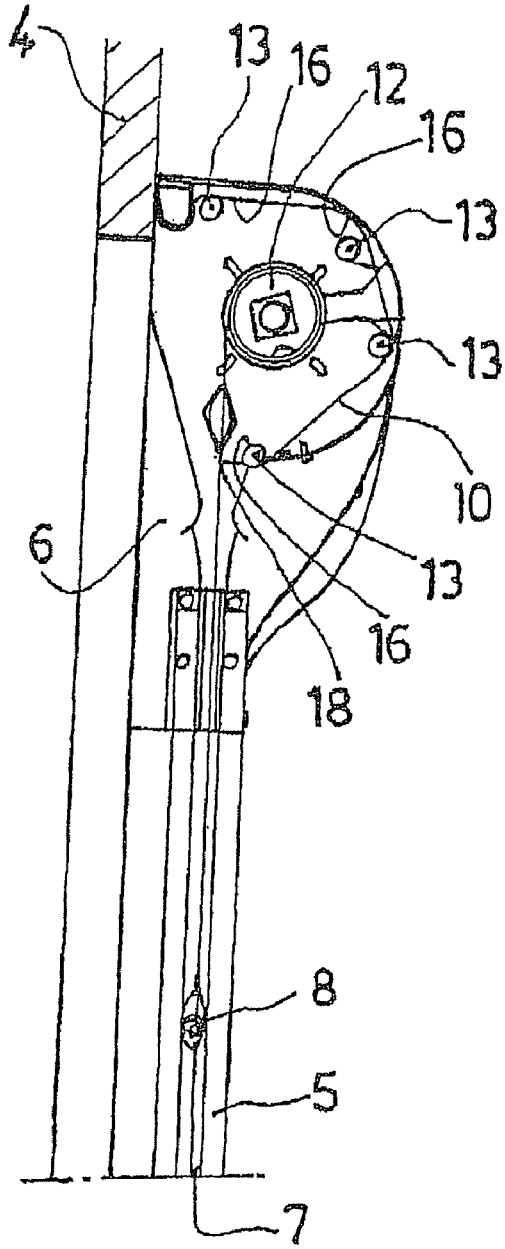
FIG. 3 is a view in section on III-III of FIG. 2.

If reference is now made to FIG. 3 which, in cross section, shows the top part of the door, it can be seen that, in a way that is entirely specific to the invention, this door has a protective cover 10 which covers the winding shaft 12 and seals the top part of the door.

Given the lack of mechanical stability of the materials of which the protective cover 10 is made, this cover is stretched over transverse support means.

In the example illustrated in FIG. 2, the transverse support means consist of bars 13 of tubular cross section which are supported at each of their ends by the fixtures 6. There may be four of these bars surrounding the shaft 12 over approximately 210°.

As can be seen in FIG. 2, the four transverse support bars 13 are parallel to the axis of the shaft 12 and positioned parallel about this shaft. The distance between the shaft 12 and the nearest bar 13 is substantially equal to, but slightly greater than, the radius of the shaft 12 when the entirety of the curtain 7 is rolled up on this shaft, that is to say when the door is open.

In the case of a large sized door, it may be envisioned for the transverse support means to consist of slats made, for example, of composite material to prevent pockets from forming in the protective cover 10.

It may be noted that the transverse protective cover 10 may be equipped with sleeves 16 to accept the bars 13. However, it will also be noted that there is no need for each of the reinforcing bars to be engaged in a sleeve 16. Thus, as can be seen in FIG. 3, the third bar working in the clockwise direction from the top bar 13 is simply in contact with the protective cover 10 and allows the protective cover 10 to stretch over this bar.

One important aspect of the transverse protective cover 10 which will therefore conceal and protect the winding shaft 12 is that it is extended at its free end by a skirt 18 which presses against the curtain 7.

It can thus be seen that extremely effective sealing is achieved between the transverse protective cover 10 and the skirt 18 because at least linear and, in practice, area, contact is achieved between the protective cover 10 and the curtain 7.

At its other end, the protective cover 10 may be fixed directly to the lintel so that no air or dust can get through in this region. The protective cover 10 may be fixed to the lintel of the opening by sandwiching this cover between the lintel and a bar through which rivets or screws, for example, will be passed.

Aside from the fact of producing a highly satisfactory seal at the top of the door, the transverse protective cover 10 according to the invention is very much lower in cost than a fabricated or extruded rigid transverse cap.

It will also be noted that, through its very nature, the protective cover 10 is therefore flexible and allows vibrational uncoupling between each of the lateral parts that form the door. The door, equipped with a transverse top protection cover 10 according to the invention, therefore operates less noisily than a door comprising a rigid transverse cap.

Furthermore, it is possible for the top part of the door to be fully harmonized with the curtain 7 because the protective cover 10 and the curtain 7 may, in practice, be made from the same material, this obviously not being the case with the transverse caps of doors of the prior art.

Figure 4:
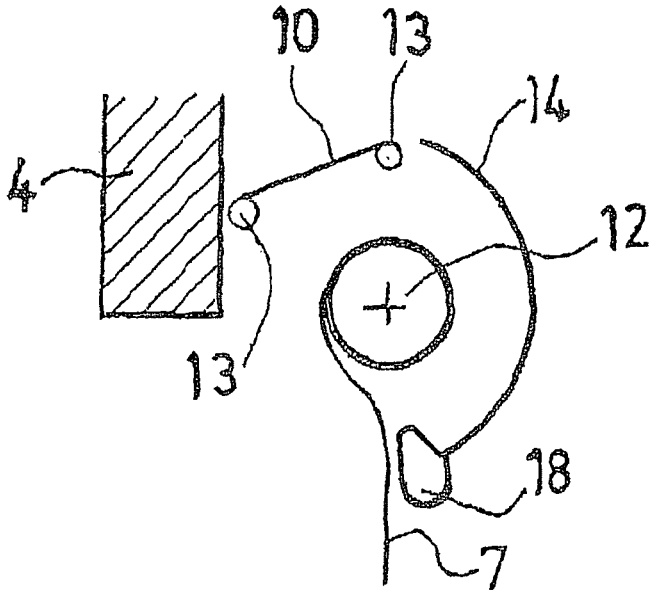
FIGS. 4 and 5 show, in cross section, several embodiments of the door according to the invention.
Figure 5:
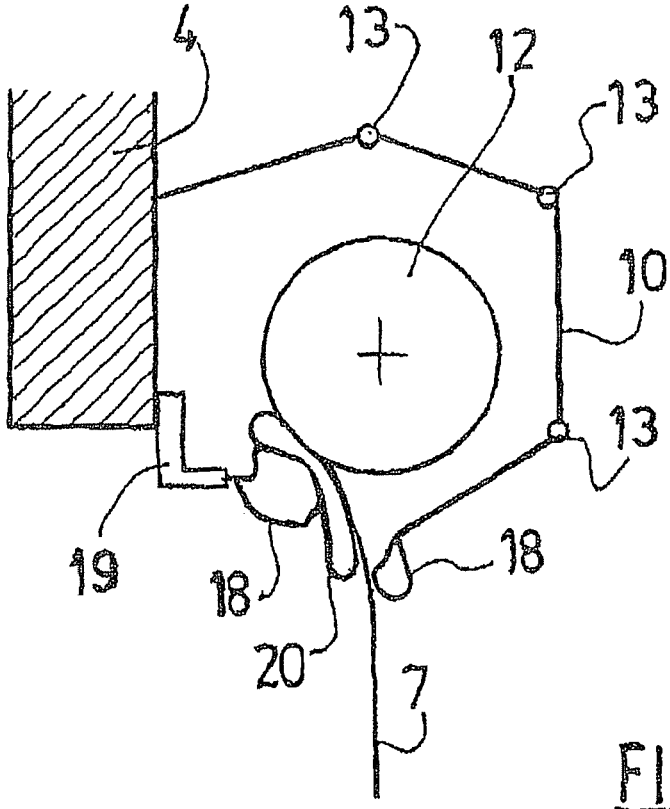

FIGS. 4 and 5 show, in cross section, two other embodiments of the means of protecting the shaft 12.

It may be envisioned, as has been depicted in FIG. 4, to fit a hybrid cap combining a rigid cap part 14 and a flexible protective cover part 10. In the example shown, the protective cover 10 prevents vibrations or sound waves from being transferred to the rigid cap 14. Note that the rigid cap 14 supports the sealing skirt 18 whereas the protective cover 10 is stretched over transverse bars 13.

In managing the sealing at the transverse top part, the door depicted in FIG. 5 affords an additional degree of sealing.

This is because the door illustrated in that figure is provided with second sealing means which press against the second face 7*b* of the curtain 7 when this curtain is in the closed position.

Provision is made for a profile strip 19, in this instance an L-shaped angle bracket, to be fitted to the lintel of the opening, this profile strip 19 supporting a skirt 18 of flexible material, or possibly a flexible roll containing a cellular foam.

Thus, the door at the transverse top part has first and second sealing means which press against each of the faces of the curtain 7 and afford an excellent barrier against the propagation of drafts.

To enhance the sealing, provision may be made for an additional thickness 20 to be positioned on one or both faces 7*a*, 7*b* of the curtain 7, this additional thickness pressing against the skirt 18 or against the roll. The additional thickness 20 is positioned on the curtain 7 such that it faces the skirt 18 or the roll when the curtain 7 is lowered and is in the closed position.

In practice, the additional thickness 20 may comprise a sheath filled with foam which is, for example, adhesively bonded or ultrasonically welded to one face of the curtain 7. The additional thickness 20 preferably has a relatively flat configuration so as not to impede the winding of the curtain 7 on to the shaft 12.

When the curtain 7 is provided with two additional thicknesses 20, it may be envisioned for these to be offset from one another so that the curtain 7 can be rolled up without difficulty.

Of course, the invention is not restricted to the embodiment described by way of nonlimiting example in the figures.

Of course, a transverse protective cover 10 like the one that has just been defined can perfectly well be fitted to a folding door. It is also possible to envision using other support means in place of the transverse bars over which the protective cover 10 is stretched. These may, for example, involve cables stretched between each of the fixtures.

There are numerous conceivable solutions for providing sealing between the protective cover 10 and, on the one hand, the curtain 7 and, on the other hand, the lintel of the opening. It is possible, for example, to equip the protective cover 10, at each of its transverse edges, with rolls, possibly filled with cellular foam; it is also possible to use rolls inflated with air or alternatively to engage an elastic filament of the tensioning type through a gusset made at the end of the protective cover 10.

The invention claimed is:

1. A high-speed door intended to close off an opening made in a wall, delimited by a lintel and by two vertical edges, the door comprising:

two substantially vertical lateral parts positioned against each of the vertical edges of the opening;

a shaft positioned at the lintel of the opening and rotationally driven by electromechanical means;

a curtain made of flexible material having a first face and a second face and which is connected to the shaft, rotation of the shaft being able to move the curtain between a closed position in which the curtain closes off the opening, and an open position in which the curtain uncovers the opening, flexible means of protecting the shaft which means extend between the two lateral parts and are capable of bearing against the lintel, the flexible protection means also possessing first transverse sealing means capable of bearing transversely against the first face of the curtain when this curtain is in the closed position; and at least two transverse support bars which generally extend between the two lateral parts;

wherein the flexible means extend over the transverse support bars.

2. The high-speed door as claimed in claim 1, wherein the door also has second sealing means which may bear against the lintel and press transversely against a second face of the curtain when this curtain is in the closed position.

3. The high-speed door as claimed in claim 2, wherein the curtain has, on at least one of its first and second faces, an additional thickness against which at least one of the first or second sealing means can press.

4. The high-speed door as claimed in claim 1, wherein the flexible protection means comprise a transverse protective cover covering the shaft, held by transverse support means parallel to the shaft and positioned around this shaft, the transverse protective cover being fixed to the lintel of the opening and having transverse sealing means capable of pressing against the curtain.

5. The high-speed door as claimed in claim 4, wherein, the transverse protective cover comprises several widths, at least two of which are connected by a sleeve into which a transverse support means can be engaged.

6. The high-speed door as claimed in claim 5, wherein the protective cover comprises a rectangular piece of flexible material to which at least one strip is attached in order to form a sleeve.

7. The high-speed door as claimed in claim 1, wherein each lateral part of the door comprises a vertical upright surmounted by a fixture supporting one end of the shaft and in which one end of a means of supporting the protective cover is anchored.

8. The high-speed door as claimed in claim 4, further comprising at least two transverse support bars over which the protective cover is stretched.

9. The high-speed door as claimed in claim 8, wherein at least one transverse bar is engaged in a sleeve belonging to the protective cover.

10. The high-speed door as claimed in claim 4, wherein a free transverse edge of the protective cover is provided with a sleeve each end of which is connected to a lateral part.

11. The high-speed door as claimed in claim 1, wherein the flexible means of protecting the shaft comprise a rigid part.

12. The high-speed door as claimed in claim 1 wherein the first transverse sealing means comprise a flexible skirt which extends the means of protecting the shaft and comes into contact with the curtain when this curtain is in the closed position.

13. The high-speed door as claimed in claim 12, wherein the skirt is formed of a strip of flexible material folded over on itself.

14. The high-speed door as claimed in claim 1, wherein the first sealing means comprising a roll which extends the protection means and comes into contact with the curtain when the curtain is in the closed position.

15. The high-speed door as claimed in claim 14, wherein the roll is filled with a cellular foam.

16. The high-speed door as claimed in claim 2, wherein the second sealing means comprise a profile strip that can be fixed to the lintel and to which a flexible skirt or a roll capable of pressing against the second face of the curtain is added.

17. The high-speed door as claimed in claim 1, wherein the curtain is fixed to the shaft and is rolled up on and unrolled from this shaft in order to open and close the door.

* * * * *